US007296859B1

(12) United States Patent
Branch, III

(10) Patent No.: US 7,296,859 B1
(45) Date of Patent: Nov. 20, 2007

(54) ERECTABLE ROCKING CHAIR

(75) Inventor: Jesse A. Branch, III, Winterville, NC (US)

(73) Assignee: Hatteras Hammocks, Inc., Greenville, NC (US)

( * ) Notice: Subject to any disclaimer, the term of this patent is extended or adjusted under 35 U.S.C. 154(b) by 0 days.

(21) Appl. No.: 11/512,134

(22) Filed: Aug. 30, 2006

(51) Int. Cl.
*A47C 7/00* (2006.01)

(52) U.S. Cl. ..... 297/440.23; 297/440.14; 297/440.15

(58) Field of Classification Search ..... 297/440.1, 297/440.15, 440.22, 440.23, 440.14
See application file for complete search history.

(56) References Cited

U.S. PATENT DOCUMENTS

| | | | | | |
|---|---|---|---|---|---|
| 458,808 | A | * | 9/1891 | Judd | 297/440.15 |
| 1,257,389 | A | * | 2/1918 | Platt | 297/440.13 |
| 5,350,218 | A | * | 9/1994 | Perkins | 297/440.1 |
| 5,407,250 | A | * | 4/1995 | Prince et al. | 297/440.23 X |

* cited by examiner

*Primary Examiner*—Anthony D. Barfield
(74) *Attorney, Agent, or Firm*—Ward and Smith, P.A.

(57) ABSTRACT

An erectable rocking chair is described which can be packed together in close and parallel relationship for assembly into a rocking chair with reinforced joints attaching seat to front and rear uprights.

5 Claims, 5 Drawing Sheets

ERECTABLE ROCKING CHAIR

CROSS REFERENCE TO RELATED APPLICATIONS

NOT APPLICABLE

STATEMENT REGARDING SPONSORED RESEARCH OR DEVELOPMENT

NOT APPLICABLE

INCORPORATED-BY-REFERENCE OF MATERIAL SUBMITTED ON A COMPACT DISC

NOT APPLICABLE

BACKGROUND OF THE INVENTION (1) Field of the Invention

This invention is directed to a rocking chair that can be shipped as component parts and readily assembled.

Rocking chairs are an enduringly popular item of furniture. But due to their characteristically high backs, and the extended runners that form their rocking base, they are unusually bulky chairs, which take up much space. This is a particular problem when they are packed for shipping. The shipping container must be quite large to contain the chair, and quite sturdy because all the chair's extended parts are relatively fragile.

It would be a great advantage for the manufacturers of rocking chairs to be able to ship in smaller containers, and have the chair parts packed so as to be less fragile. This can be accomplished by shipping the rocking chair in the form of unassembled components.

It is accordingly, an object of the present invention, to provide a rocking chair which is comprised of specific components, which can be packed together in close and parallel relationship, and yet readily assembled into a sturdy chair with a minimal number of steps and no particular skills. This is facilitated by use of unique corner joints which attach the seat to front and rear uprights.

(2) Description of Related Art

Applicant is aware of no prior art directly relevant to the present invention.

BRIEF SUMMARY OF THE INVENTION

In accordance with the present invention, an erectable rocking chair in the form of components which can be packed together in close and parallel relationship and yet readily assembled into a sturdy chair with horizontally and vertically reinforced joints attaching the seat to the front and rear uprights.

BRIEF DESCRIPTION SEVERAL VIEWS OF THE DRAWINGS

Figure 4:
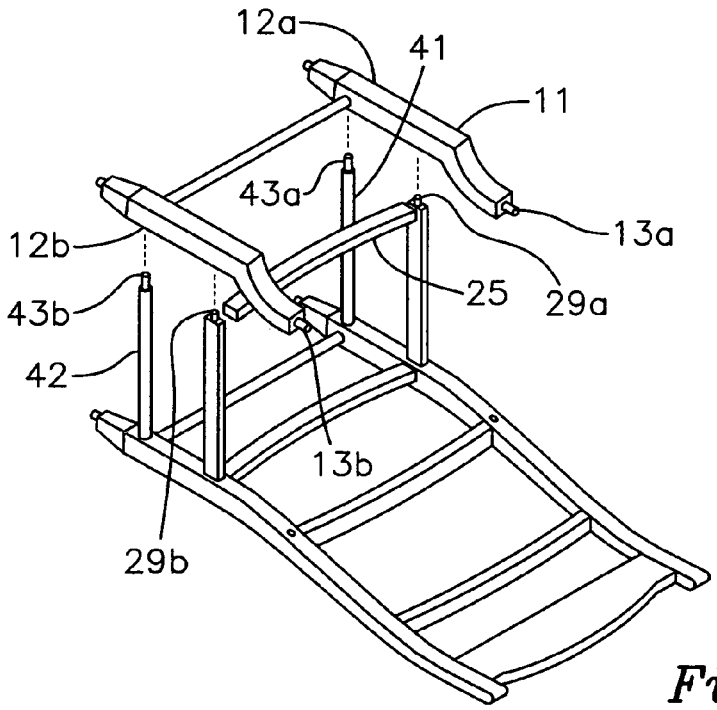
FIG. 4 is the same view with the front frame being applied
Figure 4A:
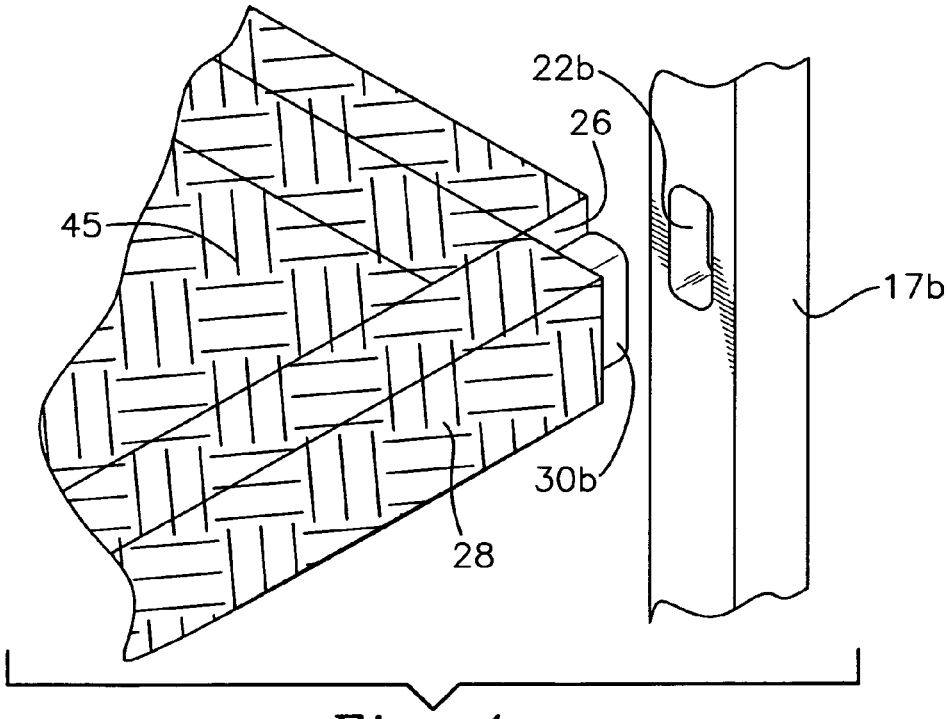
Figure 5:
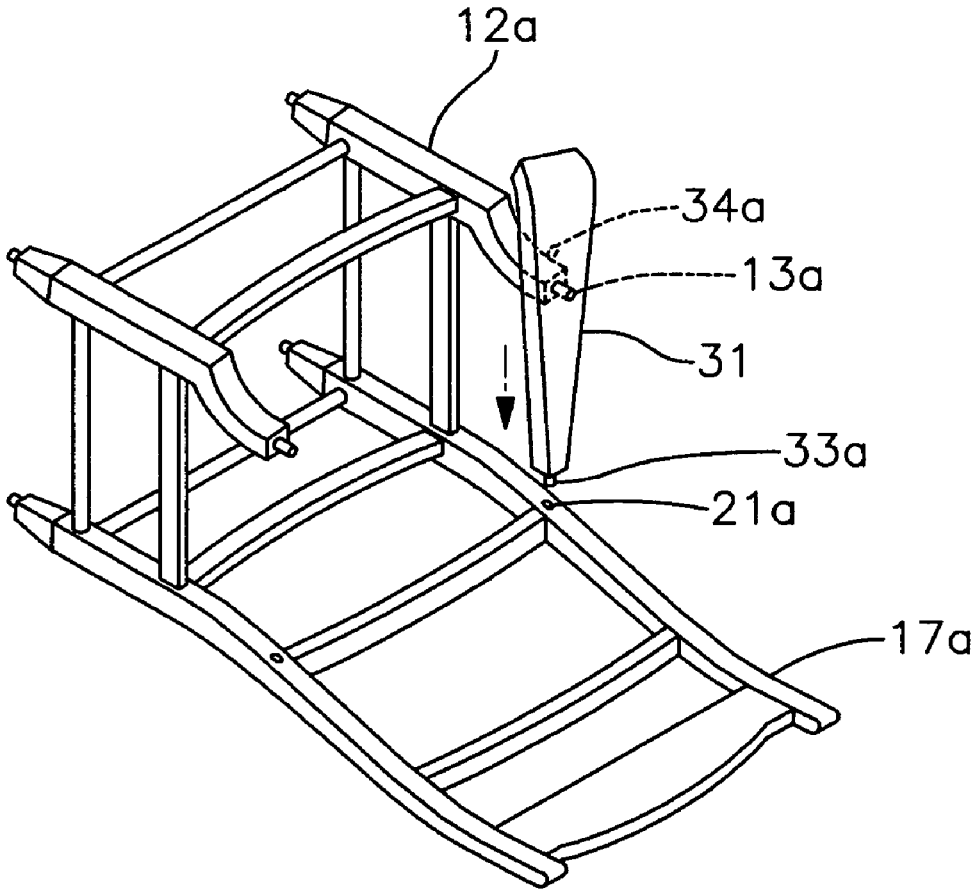
Figure 7:
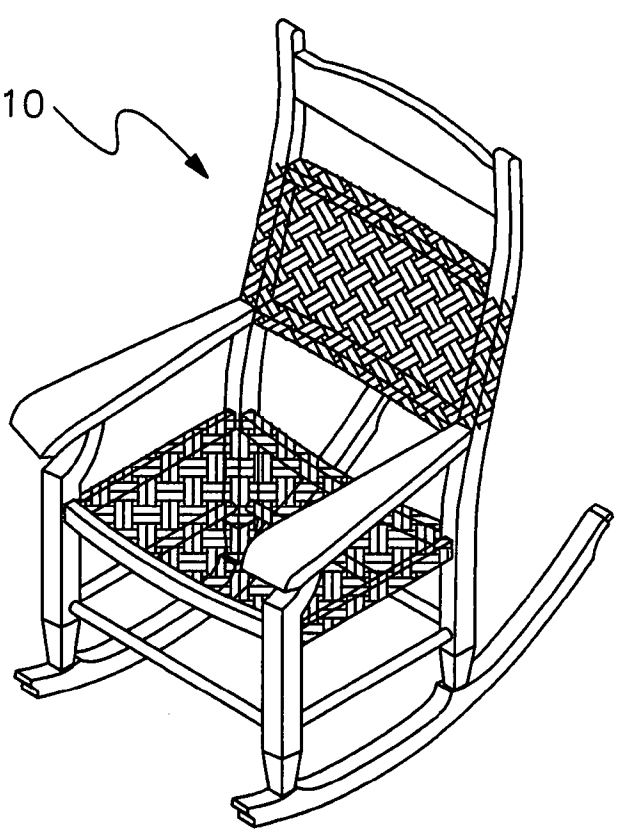
Figure 6:
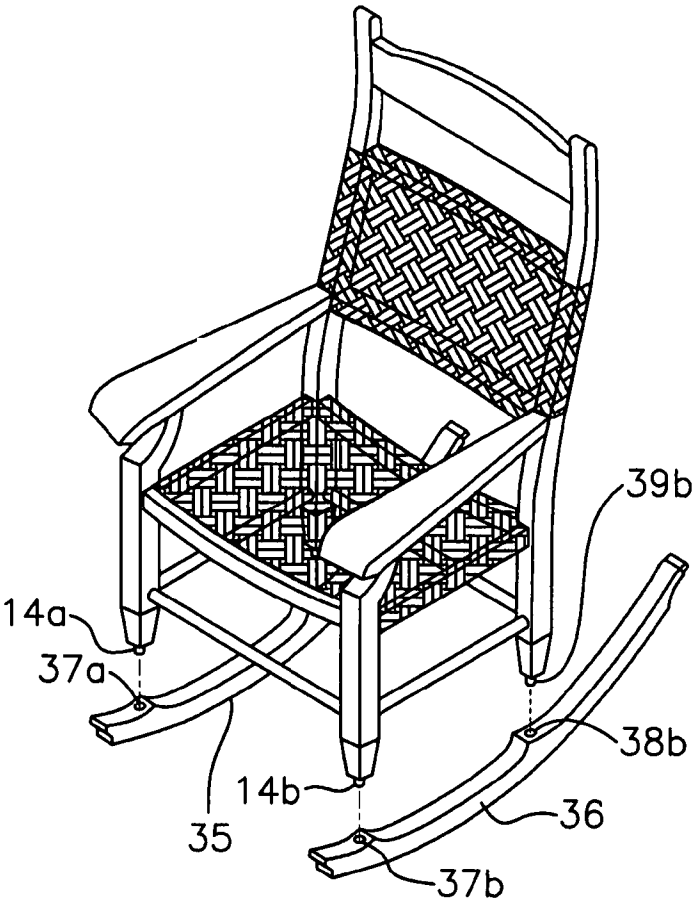

FIG. 4*a* is an enlarged view of a portion of FIG. 4, showing greater detail of the corner joint attaching seat frame to the rear frame FIG. 5 is the same view as FIG. 4, with one of the arms being applied FIG. 6 is a side perspective view of the assembled chair being inserted into the runners FIG. 7 is a side perspective view of the fully assembled rocking chair

DETAILED DESCRIPTION OF THE DRAWINGS

Reference will now be made to the present preferred embodiment of the invention.

Figure 1:
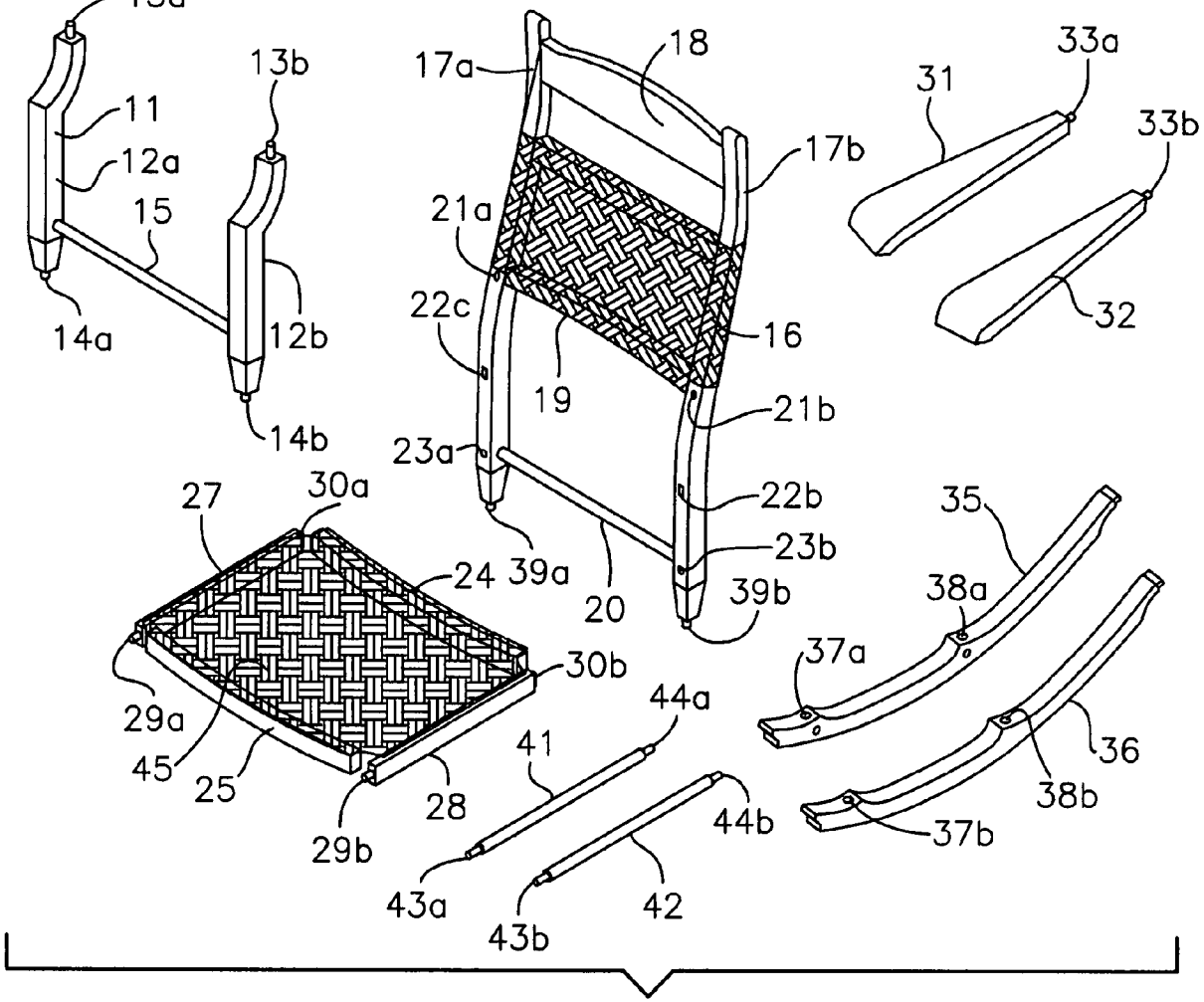
FIG. 1 is a front perspective view of the various components of a rocking chair.

FIG. 1 illustrates a rocking chair disassembled into its various components.

The front frame 11 comprises a left upright 12*a*, and right upright 12*b*. A front rail 15, extends between them, near their bottom ends. On top of uprights 12*a* and 12*b*, are formed tenons 13*a* and 13*b*. On the bottom of upright 12*a* and 12*b*, are formed tenons 14*a* and 14*b*.

The rear frame 16 comprises a left upright 17*a* and right upright 17*b*. A head board 18, extends between uprights 17*a* and 17*b* near their top ends. A woven back support 19, extends between uprights 17*a* and 17*b*, below headboard 18. A rail 20, extends between uprights 17*a* and 17*b*, near their bottom ends. The lower halves of uprights 17*a* and 17*b*, have upper mortises 21*a* and 21*b*, middle mortises 22*a* and 22*b*, and lower mortises 23*a* and 23*b*. Mortises 22*a* and 22*b* are rectangular in shape to accommodate a rectangular tenon.

Seat 24, is formed on a rectangular frame comprised of front seat frame 25, rear seat frame 26, left side seat frame 27 and right side seat frame 28. Tenon 29*b* is formed on the front end of frame 28, and tenon 30*b* is formed on its rear end. Tenon 29 is formed on the front end of frame 27, and tenon 30*a* is formed on its rear end. A woven seat bottom 45 extends between and is supported by front seat frame 25 and rear seat frame 26.

A left rail 41 is illustrated; and a right rail 42. Rail 41 has a tenon 43*a* on its front end and tenon 44*a* on its rear end. Rail 42 has tenon 43*b* on its front end and tenon 44*b* on its rear end.

Left runner 35 is essentially identical to right runner 36. Each has a front mortise 37*a* and 37*b*, as well as a rear mortise 38*a* and 38*b*.

Left arm 31 is essentially identical to right arm 32. Each has a tenon 33*a* and 33*b* formed on its rear end. Each has mortise 34*a* and 34*b* formed toward its front end.

It will be appreciated that FIG. 1 illustrates all of the individual separate components of a rocking chair. These components thus separated can be contained and packed flat in a relatively compact container, less than a quarter the size of a container required for an assembled rocking chair.

The subsequent FIG. 2 through FIG. 6, illustrate the order and method by which the components are assembled to form the rocking chair illustrated in FIG. 7. All joints are glued.

Figure 2:
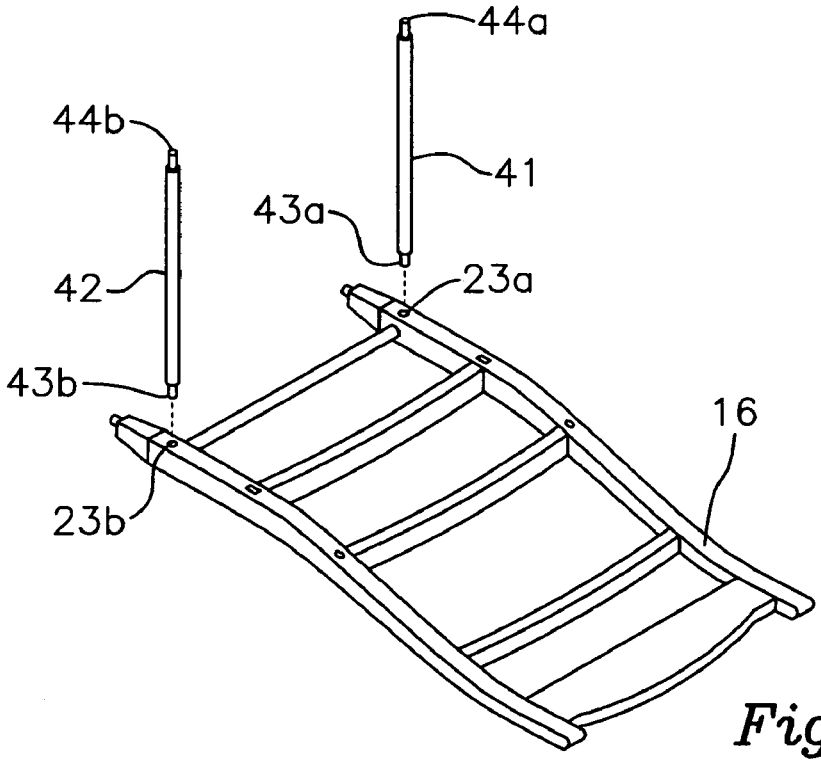
FIG. 2 is a side perspective view of the chair's back with side rails being inserted

FIG. 2 shows the insertion of tenons 43*a* and 43*b*, into mortises 23*a* and 23*b*.

Figure 3:
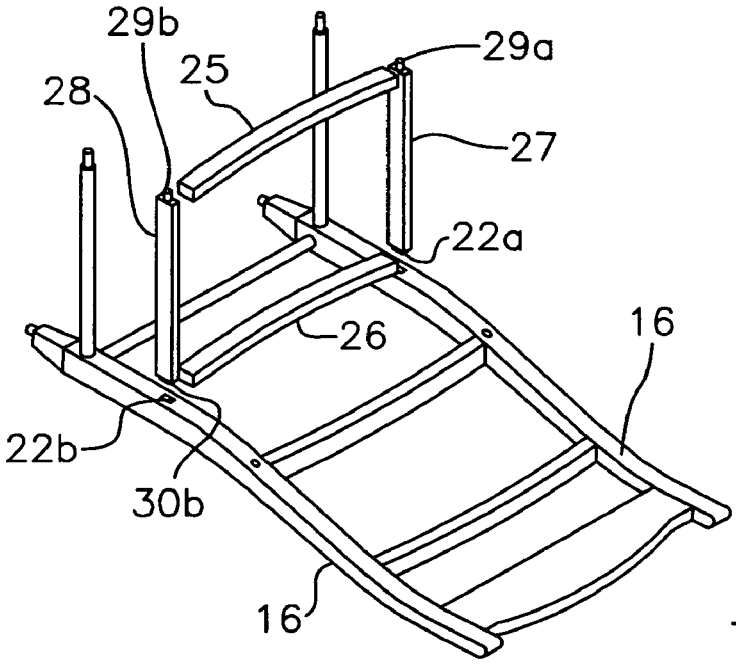
FIG. 3 is a side perspective view of the chair's back with the seat frame being inserted. To better illustrate the seat frame, woven seat bottom is not shown.

FIG. 3 shows the attachment of the seat 24 to the rear frame 16. Tenons 30*a* and 30*b* are inserted into mortises 22*a* and 22*b*.

FIG. 4 shows the attachment of front frame 11 to seat 24. For purposes of clearer understanding this view does not show the woven seat bottom 45, but only the seat frame (25,

26, 27 and 28). Mortises in the underside of uprights 12*a* and 12*b*, fit onto the tenons 29*a* and 29*b* as well as tenons 43*a* and 43*b*.

FIG. 4*a* is an enlarged detail from FIG. 4 that illustrates a distinctive feature of the present invention. Mortise 22*b* is formed in upright 17*b*. Mortise 22*b* is a relatively large mortise, and rectangular in shape. Tenon 30*b* (on the rear end of side seat frame 28) is of a corresponding rectangular shape. The joint formed of tenant 30*b* and mortise 22*b*, is particularly stable. Due to its rectangular shape, the tenon 30*b* cannot rotate, as a round tenon could. There is a space between tenon 30*b* and the adjacent end of rear seat frame 26. That space is just slightly wider than the portion of upright 17*b*, which is adjacent to mortise 22*b* on the inner side of upright 17*b*. So when the tenon 30*b* is forced into mortise 22*b*, that portion of upright 17*b* is edged into the said space between tenon 30*b* and the adjacent end of rear seat frame 26. This wedging, combined with the joint formed by tenon 30*b* and mortise 22*b* creates a juncture between the seat 24 and rear frame 16 which is both horizontally and vertically reinforced at a point subject to considerable stress. Similar junctures are formed at the other three corners of seat 24, where it is attached to uprights 17*a*, 12*a* and 12*b*.

FIG. 5 illustrates the attachment of arm 32 to uprights 12*b* and 17*b*. Tenon 33*b* is forced into mortise 21*b*, and mortise 34*b* is forced down onto tenon 13*b*. Arm 31 (not shown) is attached in the same way.

FIG. 6 illustrates the attachment of runners 35 and 36. The tenons 39*a* and 39*b* are forced into mortises 38*a* and 38*b* of runners 35 and 36. The tenons 14*a* and 14*b* are forced into the mortises 37*a* and 37*b* of runners 35 and 36. The joint formed by insertion of tenons 39*a* and 39*b* into mortises 38 *a* and 38*b*, as well as the joint formed by the insertion of tenons 14*a* and 14*b* into mortises 37*a* and 37*b*, is further strengthened by insertion of a dowel (not illustrated in the drawings) through the runner and through the tenon.

FIG. 7 illustrates the assembled rocking chair.

It will be further apparent to those skilled in the art that various modifications and variations can be made in the present invention without departing from the spirit or scope thereof. Thus, it is intended that the present invention cover such modifications and variations which come within the scope of the appended claims and their equivalents.

What is claimed is:

1. An erectable rocking chair comprising:

(a) a front upright frame and a taller rear upright frame;

(b) runners attachable to bottom ends of said upright frames; and (c) a seat attachable to and extendable between said upright frames, said seat providing a joint with said upright frames and comprising a rectangular tenon formed on the end of a side frame and insertable into a corresponding rectangular mortise on a front or rear upright wherein a space is provided between said tenon and an end of the adjacent front or rear frame, said space being slightly wider than that portion of the upright on the inner side of said mortise, said inner side portion of the upright being wedged into said space when said tenon is inserted into said mortise, said joint being horizontally and vertically reinforced.

2. The erectable rocking chair of claim 1, wherein said seat includes a seat frame comprised of a front frame, a rear frame, a left side frame and a right side frame.

3. The erectable rocking chair of claim 1 which includes left and right arms attachable to and extending between said uprights.

4. The erectable rocking chair of claim 1 which includes a rail attached to and extending between said rear uprights toward their bottom ends and a rail attached to and extending between said front uprights toward their bottom ends.

5. The erectable rocking chair of claim 4 which includes side rails, attachable to and extending between said front uprights and said rear uprights.

* * * * *